US010392926B2

(12) United States Patent
Huang et al.

(10) Patent No.: US 10,392,926 B2
(45) Date of Patent: Aug. 27, 2019

(54) LOGGING PERFORATION FLOW IN WELLBORE

(71) Applicant: SCHLUMBERGER TECHNOLOGY CORPORATION, Sugar Land, TX (US)

(72) Inventors: Songming Huang, Cambridge (GB); Pierre Vigneaux, Clamart (FR); Andrew William Meredith, Cambridge (GB); Andrew Colin Whittaker, Bangkok (TH)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/557,395

(22) PCT Filed: Mar. 2, 2016

(86) PCT No.: PCT/US2016/020518
§ 371 (c)(1),
(2) Date: Sep. 11, 2017

(87) PCT Pub. No.: WO2016/144655
PCT Pub. Date: Sep. 15, 2016

(65) Prior Publication Data

US 2018/0112524 A1 Apr. 26, 2018

(30) Foreign Application Priority Data

Mar. 11, 2015 (GB) ..... 1504088.4

(51) Int. Cl.
*E21B 47/10* (2012.01)
*E21B 43/119* (2006.01)

(52) U.S. Cl.
CPC ..... *E21B 47/101* (2013.01); *E21B 43/119* (2013.01)

(58) Field of Classification Search
CPC ..... E21B 7/061; E21B 7/068; E21B 43/04; E21B 43/11; E21B 43/119; E21B 44/00;
(Continued)

(56) References Cited

U.S. PATENT DOCUMENTS 3,127,511 A * 3/1964 Hall, Jr. ..... G01V 5/101 250/269.1
3,526,874 A * 9/1970 Schwartz ..... E21B 47/026 367/30

(Continued)

FOREIGN PATENT DOCUMENTS

EP 0513718 A2 11/1992
EP 1348954 A1 10/2003

OTHER PUBLICATIONS

Razi, S. L., et al., "Characterizing Flow Through a Perforation Using Ultrasonic Doppler", SPE 29544, Society of Petroleum Engineers, Jan. 1, 1995, 11 pages.

*Primary Examiner* — Quan-Zhen Wang
*Assistant Examiner* — Stephen R Burgdorf

(57) ABSTRACT

A measurement apparatus for non-invasively logging the flow of perforations in a well casing lining a wellbore. The measurement apparatus includes a plurality of transducers arranged adjacent an outer surface of the measurement apparatus and at predefined azimuthal angular positions with respect to a longitudinal axis of the measurement apparatus, where the transducers are adapted to transmit and detect an acoustic pulse, and where each transducer is arranged at a different azimuthal angle with respect to each of the remaining transducers.

11 Claims, 8 Drawing Sheets

(58) Field of Classification Search
CPC .... E21B 47/00; E21B 47/0002; E21B 47/005; E21B 47/02216; E21B 47/065; E21B 47/09; E21B 41/10; E21B 47/101; G01V 1/44; G01V 1/50; G01V 5/125; G01V 11/002
USPC ..... 367/81
See application file for complete search history.

(56) References Cited

U.S. PATENT DOCUMENTS 4,543,648 A * 9/1985 Hsu ..... G01V 1/44 367/29
4,805,156 A * 2/1989 Attali ..... E21B 47/0005 181/105
5,678,643 A 10/1997 Robbins et al.
7,784,339 B2 8/2010 Cook et al.
9,188,698 B2 * 11/2015 Tashiro ..... G01V 11/005
2008/0047662 A1 2/2008 Dria et al.
2008/0307877 A1 12/2008 Cook et al.
2012/0176862 A1 * 7/2012 D'Angelo ..... E21B 47/101 367/35
2012/0182831 A1 * 7/2012 Cooper ..... E21B 47/101 367/25
2013/0043381 A1 * 2/2013 Smaardyk ..... E21B 43/04 250/269.1
2013/0118809 A1 * 5/2013 Veeningen ..... E21B 47/02 175/45
2014/0204712 A1 * 7/2014 Skinner ..... E21B 47/14 367/81
2015/0144333 A1 * 5/2015 Lee ..... E21B 47/101 166/250.01
2016/0033664 A1 * 2/2016 Cheng ..... G01V 1/48 73/152.57
2017/0293043 A1 * 10/2017 Haugen ..... G01V 1/40

* cited by examiner

LOGGING PERFORATION FLOW IN WELLBORE

BACKGROUND

Embodiments of the present disclosure provide an apparatus and method for non-invasively logging the flow of perforations in a wellcasing lining a wellbore.

After drilling a well into subterranean formations for hydrocarbon recovery, wells are "completed". Typical well completion involves the insertion of a metal casing into the well, which is then cemented into place by pumping cement along the inside of the metal casing and up into the annular gap that exists between the formation and the casing. The purpose of this is several fold; it provides wellbore integrity, preventing wellbore collapse, as well as isolating the different parts of the formation from one another and with the wellbore. The casing and the cement sheath are then selectively perforated with explosive charges at desired zones. These zones are areas where fluid is produced from (or fluid is injected into). Typically these are the hydrocarbon bearing zones.

There are many parameters that can be varied in the perforation strategy in order to optimise production from a given formation, but it can be difficult to know whether the best strategy has been adopted or not. One way it can be assessed is later, through production logging, where a logging tool is inserted into the flowing well and the total flowrate measured at points along the wellbore.

FIG. 8 exemplifies such a known method. In FIG. 8, a downhole logging tool 100 is provided on a wireline 102 and lowered down a wellbore, typically with a well casing 104 lining the wellbore. As shown, a number of groups of perforations P1, P2 may be provided in the wellbore. Three measurement regions, denoted by A, B, C in FIG. 8, correspond to locations where the flowrate is measured by the downhole logging tool 100.

From the differences in flowrate between two points (e.g., B-A, C-B, or C-A), the incremental flow into the well via the collection of perforations in between can be estimated. This gives a relatively coarse measurement of perforation flow (being averaged over some length) and gives no information on a perforation-by-perforation basis that might indicate whether the direction or azimuth of the perforation influences productivity. This is also evident when two perforations are provided at opposite sides of the well casing 104, for example. Furthermore, at some deviations of the wellbore (i.e., when the wellbore is inclined, being somewhere between vertical and horizontal), there can be very strong gradients in fluid velocities and fluid holdup within the wellbore. This makes conventional production logging velocity measurements inaccurate (adding significant uncertainty to the estimates of inflow through the zone).

The concept of using pulsed wave ultrasonic Doppler to measure the flow out of oilfield perforations has been discussed in an SPE paper (SPE29544), "*Characterizing Flow Through a Perforation Using Ultrasonic Doppler*" by M. Razi, S. L. Morriss and A. L. Podio, 1995. However, since then the idea has not materialised into a commercial downhole tool. A main technical challenge for perforation flow measurement is how to align an ultrasonic transducer on a downhole tool to the centre of the perforation.

One solution is to use a motor driven rotation head that carries a transducer to perform an azimuthal scan, and this is the method used in a number of ultrasonic based borehole inspection tools, such as the UCI developed by Schlumberger, for example. Many of these prior art systems do not detect individual perforations and/or the flow from or into perforations, and these systems also detect general flow properties of fluid within the wellbore and/or structural properties of the well casing. Such an example of a rotating tool head for imaging a borehole wall is disclosed in EP 0 513 718 A2. However, a design involving moving parts and a downhole motor has reliability and cost issues and is highly undesirable. This is particularly the case when fluid flows through the well causing drag/resistance to the moving parts of the tool head, thereby adding strain to the moving parts and increasing the wear.

Another solution may be based on ultrasonic phased arrays similar to those used for medical imaging, which can perform beam forming and azimuthal scan, controlled entirely by electronics. This removes the need for mechanical moving parts. However, this technique may not be readily appropriate for production logging applications. Such systems involve a large number of transducer elements (in some cases, this may be over 1000), each of which is a few square millimeters in size, and provided in a grid or matrix type arrangement around a tool body forming a shell-type array. During measurements, large numbers of transducer elements need to be grouped together to form a beam that ideally focuses on a casing, wherein different groups are sequentially selected to scan the beam azimuthally. The small size of the transducer elements themselves, the small separation distances therebetween, and the vast number of transducer elements, requires many electrical connections, which raises reliability issues, particularly when exposed to the environments within the wellbore. The complexity and the cost of the system are also major concerns. Furthermore, the design of these systems is heavily dependent upon the wellbore diameter and packing the electronics within a production logging tool adds further complexity and challenges to the design. Moreover, when employed in a production logging tool, the small radius thereof leads to a large surface curvature of the transducer elements, meaning that it becomes more difficult to group transducer elements together to form the desired beam. This can limit the focal distance of the tool meaning that large diameter casing cannot be imaged.

EP 1 348 954 A1 discloses an array of transducers positioned around a cylindrical body, wherein the transducers are used to survey the well casing via beam steering. Properties of the fluid, particularly the composition, can be determined through a pitch/catch geometry. The transducers are arranged monolithically (in an n×m matrix) so as to enable the steering of beam in the vertical direction by applying delays to each of the transducers. This array comprises a large number of transducer elements, and the focal distance must be taken into consideration.

U.S. Pat. No. 7,784,339 discloses a perforation logging tool and method that specifically measures properties of perforations using an array concept. The embodiment uses a flexible array of sensors on a wire mesh expandable screen that is to be pressed against the wall of the casing. Such a system uses non-acoustic and non-Doppler sensors (particularly; hot film flow sensors, temperature, fluid conductivity, dielectric, chemical, viscosity, density and stress (piezoelectric)), and is arranged such that the sensors are positioned proximate to and intimately with the perforations.

There exists a need, therefore, for detailed logging on a perforation-by-perforation basis, regardless of wellbore orientation and size, in order to reveal how well the perforations are performing. Preferably, this will allow the perforation strategy within a given formation to be refined.

Moreover, there exists a need for a practical implementation of ultrasonic Doppler measurements of perforation flow in the demanding downhole environment that uses a much reduced number of transducer elements but allows for a combination of good azimuthal resolution with design simplicity. Furthermore, a non-invasive means for obtaining measurements is required, thus providing more reliable measurements of flows from perforations.

SUMMARY

The technical problems described above are solved in embodiments of the present disclosure by a downhole measurement apparatus for use logging tool, the measurement apparatus adapted to non-invasively log the flow of perforations in a well casing lining a wellbore. The measurement apparatus comprising a plurality of transducers that are arranged adjacent an outer surface of the measurement apparatus and at azimuthal angular positions with respect to a longitudinal axis of the measurement apparatus. The transducers are adapted to transmit and detect an acoustic pulse, and each transducer is arranged at a different azimuthal angle with respect to each of the remaining transducers. At least one of the plurality of transducers is located at a different longitudinal position along the longitudinal axis, such that the transducers are provided in a staggered arrangement.

In embodiments of the present disclosure, a measurement apparatus comprises a number of transducers which are able to transmit acoustic pulses to a well casing and subsequently receive reflected acoustic pulses. Preferably, the transducers use a range-gated Doppler measurement technique in order to identify a size of a perforation (from a reflectance/transmittance profile) and the fluid velocity exiting or entering the perforation based on the Doppler shift.

In an advantageous configuration, the transducers are positioned at a set distance from the well casing when the measurement apparatus is disposed down the wellbore. Moreover, the transducers are preferably arranged such that an active surface faces the well casing.

The transducers are preferably arranged at different azimuthal positions around the outer surface of the measurement apparatus. Preferably, the transducers are also positioned in a manner both axially and azimuthally thereby covering a full 360° view with respect to the longitudinal axis of the measurement apparatus at the desired angular resolution. This is preferably performed with the minimum (or a limited) number of transducers such that the fields of view of the transducers do not completely overlap (there may be a partial overlap with one or more adjacent transducers).

In one configuration, each transducer faces radially outward from the measurement apparatus, i.e., with respect to the longitudinal axis. The transducers may have a flat face, as in no curvature, or the transducers may have a face that is concave in order to aid in focusing. This is different to the convex surfaces used in other cylindrical arrays. However, the transducers may also be provided at an angle with respect to the radial direction. In this case, the measurement apparatus may be further configured to determine the relative angle of the well casing that the transducers cover. This may be an active process, or it may be pre-set in a computing unit of the measurement apparatus or the like.

Preferably, at least one transducer may be positioned at both a different azimuthal angle and longitudinal position with respect to the remaining transducers. Preferably, each transducer may be provided with a unique azimuthal and longitudinal position with respect to the measurement apparatus; that is, a unique co-ordinate defined by the azimuthal angle and the longitudinal position may be assigned to each transducer.

As the measurement apparatus is lowered down the wellbore, the transducers may be operated at a predetermined time, wherein the predetermined time corresponds to a transmitting and receiving cycle of an acoustic pulse at the same longitudinal position of the well casing. In other words, the present invention provides a staggered arrangement of transducers such that each horizontal plane of the tool comprises a limited number of transducers. This limited number of transducers means that the transducers can be provided in a manner that does not restrict the focal distance because the transducers can have a flat or concave face, as opposed to the convex face. A limited number of transducers in each plane may not provide a satisfactory azimuthal view—i.e., "gaps" may appear in a 360° image using a limited number of transducers. To compensate this, the present invention employs further transducers at different longitudinal and azimuthal positions. That is, the azimuthal resolution is compensated for by the axial positions of the transducers. A complete 360° view (at a desired resolution of a point of interest) is obtained once all the transducers have passed the point, i.e., once the measurement tool has been lowered.

In some embodiments, the desired measurements can be obtained while the measurement apparatus is moving down the wellbore, preferably at a constant logging speed. The measurement apparatus does not require any stopping time in order to obtain the measurements, meaning that the overall logging process can be much quicker. The axial resolution may also depend upon the logging speed and can be controlled accordingly, offering a greater flexibility.

Providing such an arrangement enables the logging of a well casing to a desired accuracy, while avoiding the use of moving parts. Moving parts, particularly rotating parts, can cause disturbances to the tool and/or fluid surrounding the tool, and also experience drag when moving. Embodiments of the present disclosure advantageously avoid using moving parts, which means that the system is inherently more robust and has improved longevity. Moreover, the transducers are provided in a non-intrusive manner, in that they do not contact the well casing. Therefore, the flow from the perforations is not disturbed, meaning that the obtained measurements of the perforation flow/size are more accurate.

Equally, embodiments of the present disclosure may minimise the number of transducers and hence electrical connections, thereby significantly reducing the complexity of the measurement apparatus. The physical size of the measurement apparatus may also be reduced, thus meaning that more space is available on the downhole tool for other components, or the tool length can be shortened.

In some embodiments, any of the measurement apparatuses above may further comprise a plurality of modules stacked upon each other extending along the longitudinal axis of the measurement apparatus. Each module may contain one or more of the plurality of transducers spaced around a longitudinal axis of the module at different azimuthal positions, wherein the modules are stacked in such a way that each transducer of each module is offset in the azimuthal direction with respect to the transducers of all the other modules.

Providing a plurality of modules that are stacked in a certain configuration can simplify the construction of the measurement apparatus on/in the downhole tool. This may also include simplifying various electrical connections. Moreover, this allows easier transportation and complete customisation of the measurement apparatus.

In one configuration, the modules may be identical, and each module may be offset with respect to all modules in the stack. This simplifies the manufacturing process, as only one module type is required. Moreover, this also allows complete customisation of the measurement apparatus as, depending on the desired resolution, the number of modules and relative offset angles therebetween can be altered.

In yet other embodiments, in particular, further to the embodiment above, the measurement apparatus comprises a plurality of couplers, the couplers adapted to couple a first module to a second module such that each transducer of each module is offset in the azimuthal direction with respect to the transducers of all the other modules.

Particularly when employing modules, the provision of a coupler coupling the modules together can improve the stability of the measurement apparatus. The coupler may, preferably, be formed from metal. Moreover, the coupler can also be used to define the angle between the modules, either in a fixed fashion or in an adjustable way. This further simplifies the alignment process when assembling the modules to form the measurement apparatus. The couplers may also be identical.

Some embodiments provide the measurement apparatus according to any of the above, wherein each of the transducers, or a pair of transducers, are arranged at different positions along the longitudinal axis of the measuring apparatus, thereby forming a helical pattern.

In some embodiments, the transducers are provided in a helical pattern along the longitudinal axis of the measurement apparatus. Preferably one helix is employed, although one or more, for example, a double helix pattern, may also be employed. The helix arrangement realises the same advantages as above because the transducers are provided at unique azimuthal and longitudinal positions. Azimuthal resolution may be defined by the azimuthal angle between transducers, while the axial resolution may be dependent on the logging speed of the tool.

In some embodiments the measurement apparatus comprises a measurement apparatus comprising a plurality of modules stacked upon each other extending along the longitudinal axis of the measurement apparatus, each module containing one or more of the plurality of transducers arranged at different positions along the longitudinal axis of the module and at different azimuthal positions, wherein the modules are stacked in such a way that each transducer of each module is offset in the azimuthal direction with respect to the transducers of all the other modules.

As above, the helix pattern may also be split into modules forming the measurement apparatus. In this case, for example, four transducers may be arranged in a part of the helix pattern, wherein each transducer is offset from each of the reaming transducers of the module at an angle and along a longitudinal position. When stacked, the helix pattern can be restored. This simplifies manufacturing and also transportation of the measurement apparatus, i.e., prior to assembly.

In some embodiments, the measurement apparatus further comprises an electronics module adapted to sequentially trigger the transducers.

An electronics module may be either built into the measurement apparatus or provided as a separate component and attached thereto. Equally, the electronics module may be carried by the downhole tool, or may be located on the ground, i.e., at the same or higher level than the mouth of the wellbore. Signals, such as readings from the transducers, may be sent to the electronics module. The signals may be stored and/or processed in the electronics module. Additionally, the electronics module may control the transducers to operate, i.e., transmit and receive acoustic pulses, according to an appropriate sequence.

The sequence may be programmed by a technician when installing the measurement apparatus, or may be detected automatically by the electronics module. For example, when using modules, each electrical connection from the modules may be inserted into a specific ordered socket of the electronics module corresponding to the longitudinal position of the module. In this way, the electronics module may calculate the number of modules and determine the appropriate sequence.

Triggering the transducers in a specific sequence enables appropriate measurements to be taken while minimising the interference from signals emitted by other transducers. The sequence may also comprise triggering two or more transducers at the same time. Preferably, each transducer uses a separate frequency or and/or channel in this case.

In some embodiments, the transducers are adapted to be triggered in a sequence that takes into consideration a moving speed of the measurement apparatus when carried by the downhole logging tool such that, in one cycle, each transducer detects a different azimuthal angle on at least the same plane intersecting the wellbore perpendicularly to a longitudinal axis of the wellbore.

Preferably, the triggering sequence is configured such that the transducers obtain readings from the same plane. The plane may be within a certain axial resolution (i.e., has a certain thickness). This is particularly the case when some of the transducers have the same longitudinal positions along the axial direction of the measurement apparatus. Providing the readings at the same plane allows for a complete azimuthal scan over 360° to be performed and subsequently analysed. In one cycle, it may be that all the transducers operate once to obtain readings at the same plane. In some cases, depending on the triggering sequence, readings from two or more planes may be obtained in one cycle. The electronics module may also be provided with a speed sensor for sensing the logging speed, and may adjust the sequence timing if desired. This enables an adaptive triggering sequence.

In some embodiments, the measurement apparatus is configured such that the transducers are adapted to detect a Doppler frequency shift in the acoustic signal reflected back from the proximity of the well casing to the transducers. In order to detect the size and flow of the perforations, range-gated Doppler measurements are preferably used. This enables signals in the proximity of the perforation mouth, e.g., within 1 cm thereof, to be detected. Such measurements allow detailed information directly obtained from the perforations, on a perforation-by-perforation basis.

Embodiments of the present disclosure provide a measurement apparatus, wherein one or more transducers further comprise only one or only two extension portions situated above and/or below the transducer, the extension portions being additional transducers, wherein preferably, the extension portions are tilted relative to the longitudinal axis of the measurement apparatus.

The transducers may also be provided with extension portions. The extension portions are preferably different in size to the transducers, but may be made and operated in a similar manner to the transducers. The extension portions may be positioned either above or below the transducers; preferably, only one is positioned above and/or below. The extension portions primarily increase the vertical height of the transducer which is a condition that affects the focal zone of the acoustic pulse. Increasing the height of the transducer typically increases the near field focal zone. The extension portions may be operated in advance of the transducer, so as to allow the acoustic pulse therefrom to arrive at the well casing at the same time as the acoustic pulse from the transducer. Providing the extension portions enables the opportunity to alter the focal zone of the transducers, thus allowing the measurement apparatus to be disposed in larger diameter wellbores.

The problem is also solved by a downhole logging tool comprising any of the measurement apparatuses above. The measurement apparatus may form part of a downhole tool, and may be integral with the tool or removeably attached thereto. The downhole tool may comprise any number of additional components, i.e., the measurement apparatus is only one of many components carried by the tool.

The problem is also solved by a method of non-invasively logging the flow of perforations in a well casing lining a wellbore, the method comprising:

- providing a measurement apparatus according to any of the above; and
- transmitting and detecting acoustic signals using the plurality of transducers, wherein, in the presence of a perforation, the acoustic signals interact with the flow from or into the perforations.

In some embodiments the method above further comprises:

- providing the plurality of transducers at different positions along the longitudinal axis of the measurement apparatus;
- lowering the measurement apparatus down the wellbore; and
- transmitting the acoustic signal from each transducer when each transducer is level with at least one reference point defined relative to the axial length of the wellbore.

This method enables the transducers to obtain data at approximately the same point relative to the wellbore axis, thereby enabling an image of the well casing ranging from 0 to 360° to be produced. In this regard, level can also be understood to mean within the axial resolution of the tool.

In some embodiments, the axial resolution obtained by the measurement apparatus is dependent upon the velocity of the measurement apparatus in a vertical direction down the borehole.

In some embodiments, the method provides any of the methods above, and further comprises:

- detecting a reflectance and/or transmittance associated with the acoustic signals of each transducer along the radial depth of the well casing;
- detecting a radial flow velocity profile associated with the acoustic signals of each transducer along the radial depth of the well casing;
- deriving a flow rate using the detected reflectance and/or transmittance and detected radial flow velocity profile,
- wherein, in the presence of a perforation, the reflectance and/or transmittance and radial flow velocity are different compared to when a perforation is not present.

Measuring these parameters enables data to be collected regarding the characteristics of individual perforations in the well casing. This means, in one use, that a database can be provided wherein the characteristics of the perforations are catalogued against the used perforation method and/or surrounding environment/formation. Such a database can be used to determine the performance of certain perforations and to influence perforation method and strategies to be used in future wellbores.

These and other aspects of the invention will be apparent from and elucidated with reference to the embodiments described hereinafter.

BRIEF DESCRIPTION OF THE DRAWINGS

The present disclosure is described in conjunction with the appended figures. It is emphasized that, in accordance with the standard practice in the industry, various features are not drawn to scale. In fact, the dimensions of the various features may be arbitrarily increased or reduced for clarity of discussion.

Figure 1:
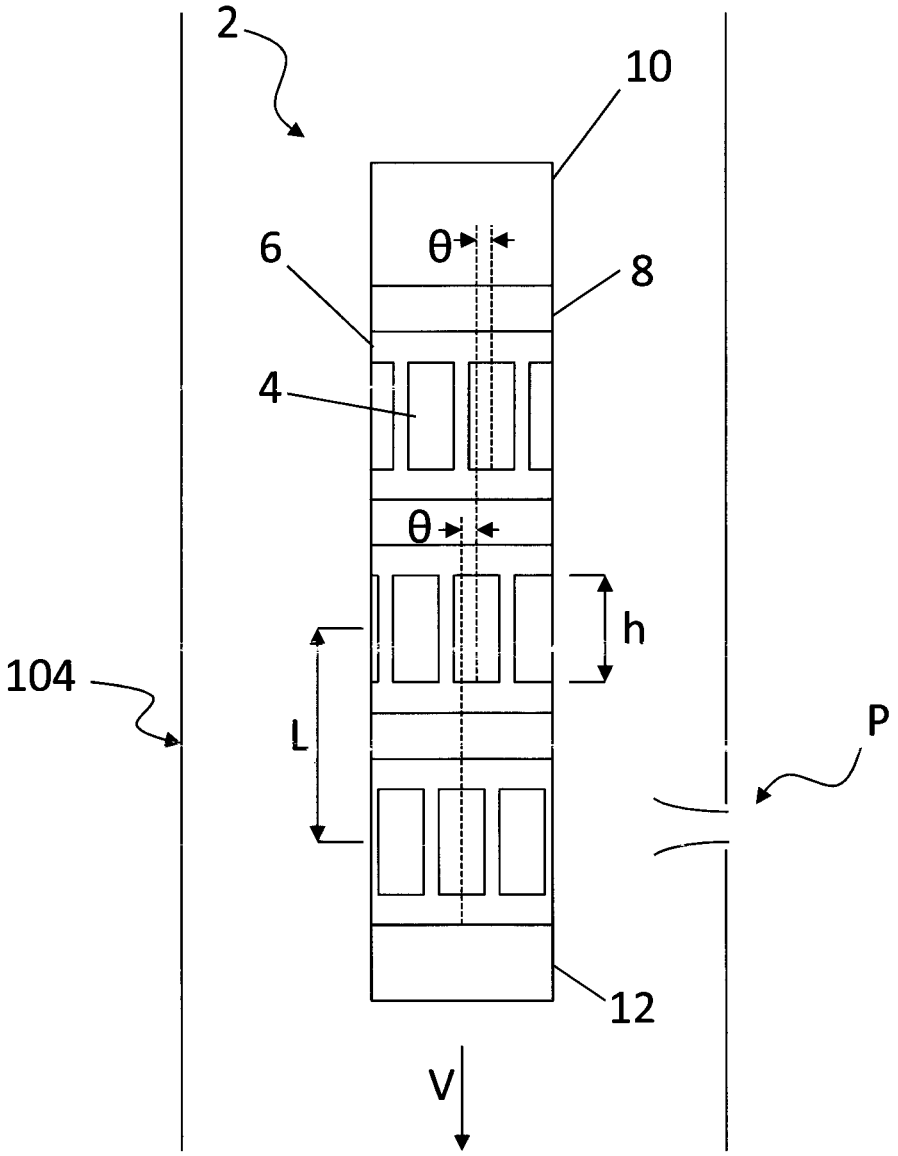
FIG. 1 shows a measurement apparatus according to one embodiment of the present disclosure.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The detection and measuring of the flow of perforations in a well casing 4 lining a wellbore can be performed by transmitting acoustic pulses towards the direction of the well casing 4 and subsequently measuring the received acoustic pulses. In the presence of a perforation P, fluid entering or exiting the perforation P will usually contain some acoustic or ultrasonic scatterers such as sand particles, liquid droplets, or gas bubbles. These scatterers move with a certain velocity and subsequently cause a Doppler shift in the frequency of a reflected acoustic wave, which is dependent on the magnitude and direction of the velocity. Sufficient thermal or density contrast between fluid in the perforation P and that in the borehole and a mixing of the two at the mouth of the perforation P should also produce the scattering effect needed by the Doppler measurement. Embodiments of the present disclosure make use of this principle to obtain information relating to perforations P in a well casing 104.

FIG. 1 shows a measurement apparatus 2 according to an embodiment of the present disclosure. The measurement apparatus 2 is shown relative to a well casing 104 which, as discussed above, is disposed so as to line a wellbore. FIG. 1 also shows one perforation P provided in the well casing 104, wherein the perforation P may be created according to any of the well-known techniques discussed above.

The measurement apparatus 2 is preferably carried by or disposed on a downhole tool for deployment down a wellbore. While the tool is not shown in FIG. 1, it should be appreciated that the tool extends above and/or below the components shown in FIG. 1. In some arrangements, the measurement apparatus 2 may be provided surrounding a longitudinal part of the tool body, for example, by the longitudinal part being threaded through a central opening extending the length of the measurement apparatus 2. Alternatively, the tool may be of modular construction, in which case components of the tool may affix to the upper or lower parts of the measurement apparatus 2. It should be appreciated that the tool may be of any length and contain any type of alternative measuring equipment or the like. Preferably, when the measurement apparatus 2 and the tool are provided in a useable arrangement, the longitudinal axis of the measurement apparatus 2 approximately coincides with the longitudinal axis of the tool.

The measurement apparatus 2 includes a plurality of transducers 4 disposed adjacent the outer surface thereof. The transducers 4 may form the outer surface of the measurement apparatus 2, or a part thereof, or they may be set into the measurement apparatus 2 such that a front surface thereof is covered. The transducers 4 are preferably arranged so as to transmit an acoustic pulse, when energised, to the well casing 104; that is, the transducers 4 are arranged such that an active surface faces the well casing 104. Each transducer 4 is adapted to both transmit and receive acoustic pulses. In this regard, the transducer 4 may be configured to transmit an acoustic pulse and then listen at predetermined times for a reflected pulse—this is known as range-gating. Preferably, the transducers 4 are configured to listen for signals corresponding to a distance of approximately 1 or 2 cm proximate the perforation mouth. The transducers 4 may be piezoelectric ceramic chips, preferably rectangular shaped PZT piezoelectric ceramic chips, although the transducers 4 are not limited to this. The transducers 4 preferably have a flat or concave shaped face, which offers advantageous focusing properties. In this regard, the flat or concave faces facilitate beam focusing towards the casing.

Embodiments of the present disclosure also arrange each of the transducers 4 at different azimuthal angles with respect to each other around a longitudinal axis of the measurement apparatus 2. With reference to FIG. 1 specifically, one can see that each transducer 4 is rotated in the azimuthal direction with respect to the transducer 4 below by an angle θ. As described in more detail below, such an arrangement ensures a more thorough azimuthal scan of the well casing 104. Preferably, at least some of the transducers 4 are also disposed at different positions in the longitudinal direction of the measurement apparatus 2. In this way, each transducer 4 may be provided at a unique longitudinal and azimuthal position on the measurement apparatus 2.

The transducers 4 are located at different azimuthal positions with respect to the longitudinal axis of the measurement apparatus 2. To this end, a limited number of transducers 4 may be provided at different horizontal planes intersecting the measurement apparatus 2. The transducers 4 of each plane may be arranged to accommodate various beam focusing requirements, but not necessarily azimuthal coverage. To compensate, the transducers 4 at different horizontal planes, i.e., different longitudinal positions, are also provided at different azimuthal positions. In this way, when a downhole tool moves down a well hole, the desired azimuthal imaging (i.e., to the desired resolution) can be obtained by imaging different transducers 4 at different axial/longitudinal positions to coincide with the point of interest, i.e., a perforation or horizontal plane of the well casing 104 to be imaged.

Preferably, the transducers 4 are arranged such that an active surface faces the well casing 104. Typically, the normal of the transducers 4 will coincide with the radial direction of the measurement apparatus, i.e., defined with respect to the longitudinal axis of the measurement apparatus 2.

Referring specifically now to the first embodiment, the transducers 4 may be arranged on modules 6 of the measurement apparatus 2. Each module 6 may be coupled to either another module 6, to an electronics module 10, to a header portion 12, or to a further component of the downhole tool, preferably via a coupler 8. Employing modules 6 may simplify the design and structure of the downhole tool, as well as shortening the overall tool length.

The electronics module 10 may be a module configured to operate the transducers 4 and cause them to begin transmitting and receiving acoustic pulses. Preferably, the transducers 4 are sequentially triggered, as will be discussed in greater depth below. Each of the modules 6 may be linked to a single electronics module 10 or there may be a plurality of electronics modules 10 governing a maximum number of transducers 4. The electronics module 10 may also store or log data received from the transducers 4. In an alternative arrangement, the transducers 4 may be triggered by an external electronics module 10 mounted on the ground, i.e., outside of the wellbore and in the proximity of the mouth of the wellbore. Equally, the data may be sent from the transducers 4 to a receiving unit similarly positioned.

A header portion 12 may be provided, particularly in the case where the measurement apparatus 2 is the first, i.e., lowest in FIG. 1, component on the tool. In other words, the header portion 12 may be provided to structurally protect the measurement apparatus 2 when the measurement apparatus 2 leads the downhole tool. In other cases, the header portion 12 may not be necessary.

Figure 2A:
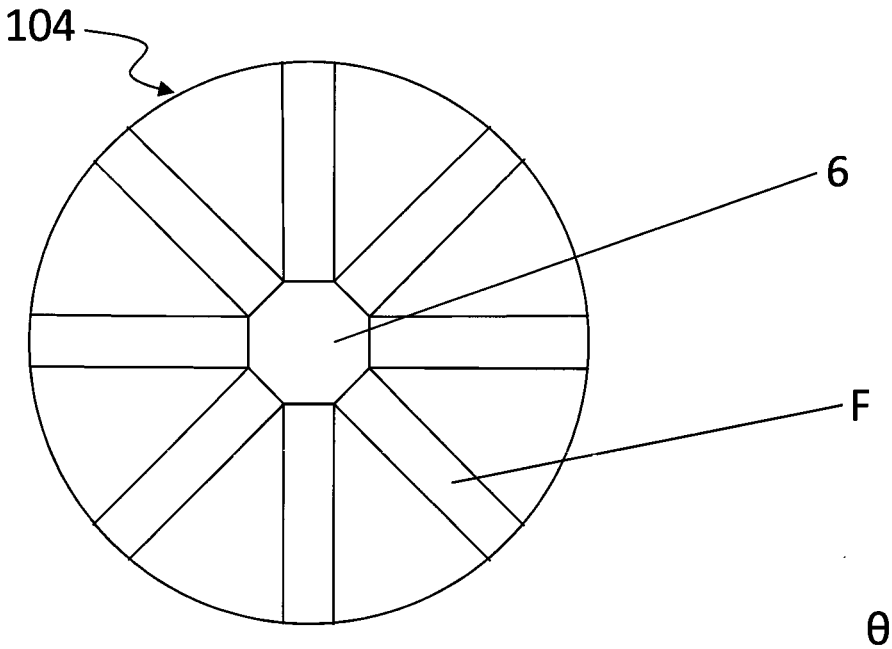
FIG. 2*a* shows a schematic representation of an azimuthal coverage of a first module.

In one arrangement, each module 6 may be identical and have the same number of transducers 4 arranged in an equally spaced fashion. Using identical modules 6 further simplifies the design and installing of the measurement apparatus 2 to a downhole tool. FIG. 2*a* is a schematic view taken from above showing an example module 6. In FIG. 2*a*, eight transducers 4 are provided. In this case, the module 6 may define a central longitudinal axis, in a similar manner and/or equivalent to the measurement apparatus 2, and each transducer 4 may be provided at a different azimuthal angle with respect to the central longitudinal axis.

In the case of eight transducers 4, each transducer 4 may be provided separated by 45° from the nearest two transducers 4 of the module 6. FIG. 2*a* also diagrammatically shows the field of view F of each transducer 4 of the module 6, wherein the field of view F is highlighted as a column for ease of representation. The actual field of view F may be a different shape. Within a measurement range of the transducers 4, i.e., the width of the field of view F in FIG. 2*a*, given for example as ΔM, the configuration of FIG. 2*a* provides measurements at a position in range of 0°±ΔM/2, 45°±ΔM/2, 90°±ΔM/2, and so on. Note that FIG. 2*a* also shows the blind spots of the module 6, wherein the blind spots are those regions outside the field of view F of all the transducers 4. The angular or axial resolution of a single module 6, in this case, is often not sufficient for a detailed scan of the wellbore.

Figure 2B:
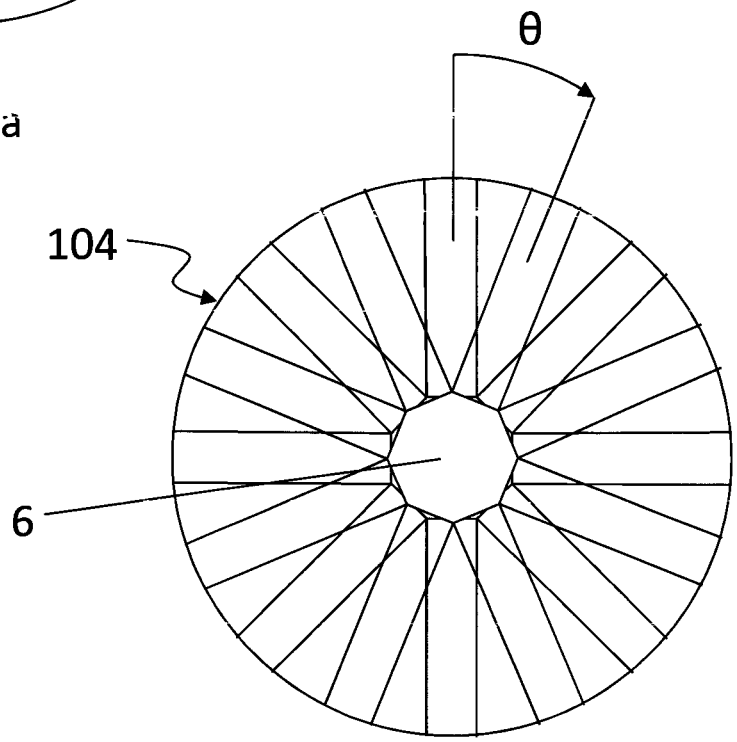
FIG. 2*b* shows a schematic representation of an azimuthal coverage of a first and second module.

As stated above, the measurement apparatus 2 may comprise a plurality of modules 6 stacked in the vertical direction of the tool. Each identical module 6 may be offset in the azimuthal direction, i.e., with respect to the central longitudinal axis. FIG. 2*b* shows a schematic view taken from above showing two modules 6 according to FIG. 2*a* stacked upon each other. As can be identified, the second of the two modules 6 is offset by the angle θ (in FIG. 2*b*, θ is approximately 22.5°) which subsequently offsets the fields of view F for the second module 6. In this way, the angular resolution can be improved compared with the case shown in FIG. 2*a*. Specifically, FIG. 2*b* provides measurements at a position in a range of 0°±ΔM/2, 22.5°±ΔM/2, 45°±ΔM/2, etc.

It should be appreciated that, the module 6 is not limited to housing eight transducers 4, but any number may be provided. In a preferred arrangement, each module may comprise between one to sixteen transducers, more preferably between six to sixteen transducers 4. In another arrangement, the module 6 may house any number of transducers 4 equal to or greater than one. Additionally, the module 6 is not limited to the octagonal shape shown in FIGS. 2*a* and 2*b*. Any cross-sectional shape may be employed, e.g., circular, triangular, square, hexagon, decagon, etc. This may also include irregular shapes.

Moreover, the angle θ, which in the first embodiment is defined as the angle between adjacent modules 6, may take any value. Depending upon the resolution required, it may be desirable to use four modules 6, each containing eight transducers 4. Then, each module 6 may be offset by 11.25° in order to cover the full 360°. Many other examples can be realised within the principles of the present disclosure. The angle θ may also be different between each pair of modules 6, if desired; for example, if the modules 6 are not identical. Moreover, it should be appreciated that the desired resolution can be realised simply by varying the number of modules 6 and/or transducers 4 per module 6. For finer scans, for instance, four modules 6, each with nine transducers 4, with a rotational angle θ of 10° between adjacent pairs of modules 6, or five modules 6 comprising eight transducers 4 with 9° rotation between adjacent pairs of modules 6, can be used.

Each of the couplers 8 may be configured to realise the rotation angle (azimuthal angle) between modules 6. The couplers 8 may be mechanically configured to align two adjacent modules 6 at a fixed rotation angle. The coupler 8 may also be formed of metal. The coupler 8 may be used to enhance the mechanical strength of the tool. The metal coupler in between two transducer rings provide the (fixed) rotational angle setting as well as enhance the mechanical strength of the tool.

In one configuration, each coupler 8 may be identical. For example, a keyway may be provided both on an upper and a lower surface of the coupler 8, wherein the top keyway is displaced by the angle θ relative to the bottom keyway. In this configuration, each module 6 may have a key located at the top and bottom thereof, wherein the upper key is also displaced by the angle θ relative to the bottom key. In an alternative configuration, the coupler 8 may be configured to adjustably rotate the upper (or lower) module 6 of the pair of modules 6 to a desired angle θ. For example, a threaded member or similar rotatable element may be provided in the coupler 8 to adjust the offset between the modules 6.

The focal zone of the transducers 4 may be primarily dependent upon the height of the transducer 4. For perforation detection, it is preferable to design a location of the transducer focal zone so that it covers the well casing 104. For a flat single transducer 4 without focal lens, its near field N is defined in equation (1) by:

$$N=h^2/4\lambda \tag{1}$$

where: λ is the wavelength and h the height (or width) of the transducer 4. The natural focal zone (i.e., where the beam is the narrowest) locates approximately from N to about 1.3 N. For instance, for a square shaped transducer 4 of 12.5 mm by 12.5 mm in size and operating at 2 MHz, the focal zone in water is approximately from 52 mm to about 68 mm from the surface of the transducer 4. For a centralised production logging tool of 95.26 mm (1 11/16") and a 152.4 mm (6") casing, the distance between them is about 55 mm and, in this example, the well casing 104 falls into the natural focal zone of the transducer 4.

In general, the operating frequency of the transducer 4 and the size of the transducer 4 (crystal size) can be appropriately selected to position the focal zone to the required size of the well casing 104. The operating frequency is preferably ultrasonic, i.e., above 20 kHz. In one embodiment, the operating frequency of the transducers 4 is between 0.1 MHz to 8 MHz, preferably between 1 MHz to 5 MHz.

Figure 3A:
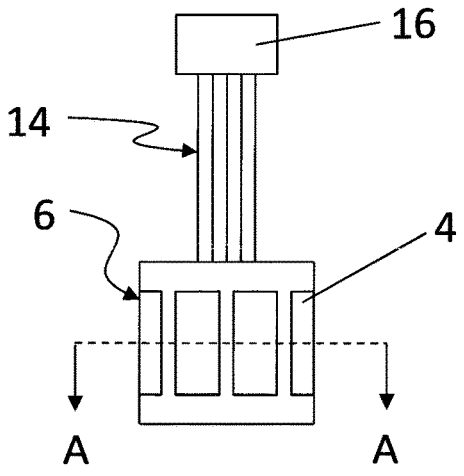
FIG. 3*a* shows a first exemplary module.

FIG. 3*a* shows an example of a single module 6. Wires 14 may extend from each of the transducers 4 provided on the module 6. Preferably, the wires 14 extend through a common bore of the module 6 to a feed-through connector 16. The feed-through connector 16 may connect directly to the electronics module 10 or to an intermediate connector that electrically connects a first and second module 6, for example. The feed-through connector 16 may be plugged into a predefined socket on the electronics module 10.

Figure 3B:
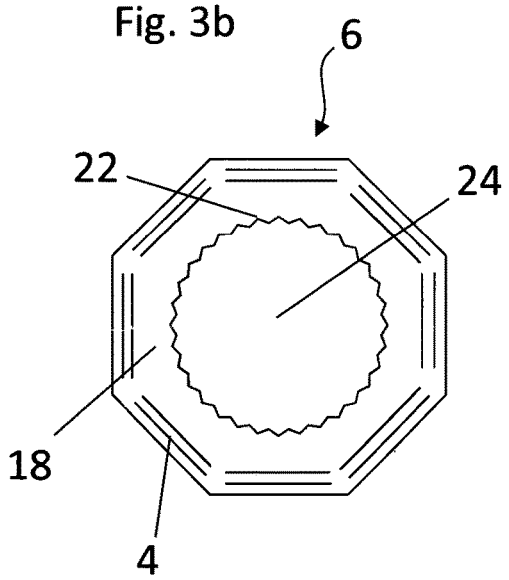
FIG. 3*b* shows a cross-section of the module of FIG. 3*a* along the line A-A.

FIG. 3*b* shows a cross-section taken along the line A-A in FIG. 3*a* of the example module. The transducers 4 are represented by two lines, one more advanced of the other, signifying a first electrode 4*a* and second electrode 4*b*; see FIG. 3*c*. The electrodes 4*a*, 4*b* of the transducers 4 may be disposed on flat surfaces of a module body 18 of the module 6, which may be made of a plastic, e.g. PEEK, or a composite material. Alternatively, the transducers 4 may be installed through a moulding process that may leave a thin layer of material, such as PEEK, on the front surfaces thereof, i.e., on the front surface of the first transducer 4*a*; see FIG. 3*c*. This layer may form the outer surface (or a part thereof) of the measurement apparatus 2.

Figure 3C:
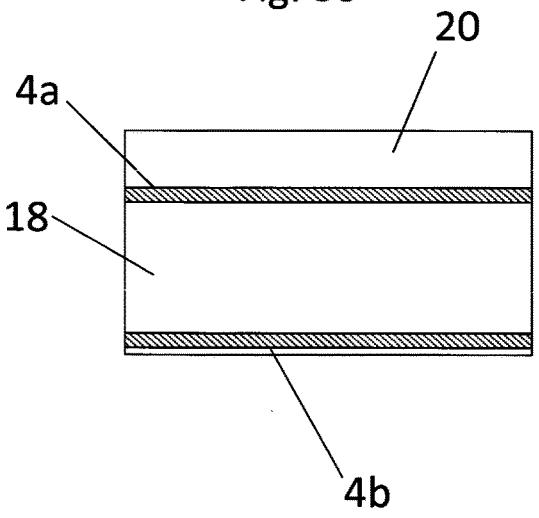
FIG. 3*c* shows an enlarged section of an outer surface of the module of FIG. 3*b;*

In FIG. 3*b*, and in more detail in FIG. 3*c*, a matching layer 20 is shown on the front side of the first electrode 4*a*, i.e., the outer surface of the module 6. The matching layer 20 may be provided using the moulding process as described above, or may be provided after the transducers 4 have been mounted to the module body 18. The matching layer 20 may be used to match the acoustic impedance of the transducers 4, i.e., the PZT material of the transducers 4, to that of the borehole fluid. The impedance of the matching layer 20, $z_m$, is defined in equation (2), and ideally, should be:

$$z_m=\sqrt{z_1 z^2} \tag{2}$$

where: $z_1$ is the impedance of the transducer material and $z_2$ is the impedance of the borehole fluid. The thickness of the matching layer 20 may typically be a quarter of the wavelength of the acoustic signal in the material of the matching layer 20, e.g., the PEEK material. A focal lens may also be implemented by designing an appropriate curvature on the front face of the matching layer 20.

Referring back to FIG. 3*b*, an inner surface of the module body 18 defining an inner bore 24 may comprise grooves 22. In FIG. 3*b*, saw-tooth shaped grooves 22 are provided, but the grooves 22 are not limited to this shape. The depth of the grooves 22 may be made to approximately a quarter of the wavelength of the acoustic signal in the material of the module body 18, or integer multiples thereof. The grooves 22 may be used to diffuse reflected acoustic pulses, such that they do not create coherent interference with the received transducer signals from the wellbore.

The inner bore 24 of the module body 18 may be filled with a fluid, such as silicone oil, which may be isolated from the borehole fluid. This may be realised by pressure transparent devices such as diaphragms or bellows, or compensating pistons. The inside and outside of module 6 may, therefore, be pressure balanced, adding rigidity and longevity to the module 6. The wires 14 may be routed through the inner bore 24, and may be provided with some form of liquid shielding.

Figure 3D:
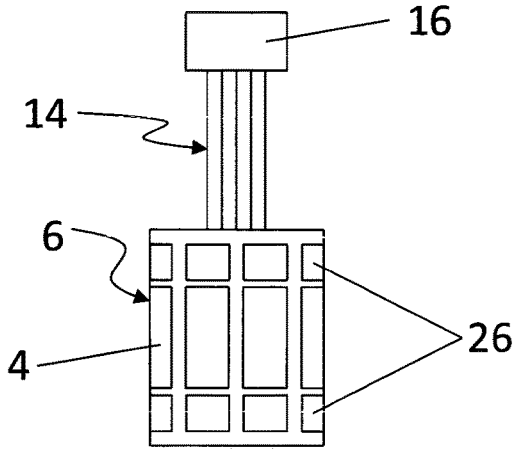
FIG. 3*d* shows a second exemplary module.

FIG. 3*d* shows a further example of the module 6, wherein extension portions 26 are provided. The extension portions 26 may be provided above and/or below the transducers 4. Preferably, only one or only two extension portions 26 are provided per transducer 4. The extension portions 26 may form part of a multi-element transducer 4, or they may be separate from the transducer 4. The extension portions 26 may act to increase the height h of the transducer 4. Therefore, with the extension portions 26, the focal zone of the transducers 4 can be altered, in accordance with equation (1). The extension portions 26 may be different to the transducers 4 or the same. In one configuration, the extension portions 26 are smaller in height than the transducers 4. The extension portions 26 may also be pulsed before the transducer 4 to thereby arrive at the focal zone on the well casing 104 at the same time as the acoustic pulse from the transducer 4 and with the same phase in order to benefit constructive interference.

In order to provide logging of individual perforations P, a fine azimuthal scan is required at various points along the axial direction of the wellbore. At each point, a complete 360° scan is required in order to detect any perforations P. In this way, Embodiments of the present disclosure define a series of planes intersecting the wellbore, each plane perpendicular to the longitudinal axis of the wellbore. In order to obtain the measurements at the defined planes, the measurement apparatus 2 is operated in a unique manner.

With reference to FIG. 1, it can be seen that each module 6 is separated from another module 6, in the longitudinal direction, by a gap L. In this example, it is assumed that four modules 6 comprising eight transducers 4 provide a sufficient angular resolution. The tool is generally sent down the wellbore at a constant speed V; i.e., a logging speed.

Assuming this is the case, the time required for travelling the gap L between any two neighbouring modules 6 is $\tau$, as defined in equation (3), wherein $$\tau = L/V \quad (3)$$

After $4\tau$, the transducers 4 on the modules 6 should have covered all azimuthal angles at the specific point or depth of the wellbore, i.e., at the same plane. The sensitivity profile of each of the transducers 4 should not limit the vertical resolution if the scan is performed fast enough.

In one embodiment, the scan may be performed sequentially, starting from the first module (lowest module 6 on the tool) and from the first to the eight transducer 4, and then to the next module 6, and so on. After the last module 6 is scanned, the process preferably restarts at the first module 6 again. The time required to scan the transducers 4 in all the modules 6 is $T_1$, which, in combination with the logging speed, V, determines the axial resolution of the inspection. For instance, with an ultrasonic Doppler system, the required acquisition time at each transducer 4 may be a few milliseconds, e.g., 3 ms. In the above example, i.e., a sequence where each transducer is triggered separately, the time required for scanning all thirty-two transducers 4 is the required acquisition time multiplied by the number of transducers 4; in the above example, $T_1$=96 ms.

The axial spatial resolution is, in this example, defined by the logging speed V multiplied by the time required for scanning all thirty-two transducers 4, $T_1$. Assuming a logging speed V of 0.1 m/s, this gives an axial spatial resolution of 9.6 mm. However, if the scans of different modules are done in parallel, with four AID converter channels for example, the time required for scanning all thirty-two transducers 4 reduces, in this case, to $T_1/4$. As a result, an axial resolution of 2.4 mm may be realised, or for the same axial resolution, an increased logging speed V of 0.4 m/s may be realised.

Regarding the variation in sequencing of the transducers 4, it should be appreciated that a number of different sequences are possible. For example, it is possible to use a different frequency or channel for the transducers 4 of each module 6. Alternatively, or additionally, it is possible to use different frequencies of channels for different transducers 4 of the same module 6. The transducers 4 may be adapted in order to enable this, i.e., be of a different size, shape, etc.

It should be appreciated that, depending upon the configuration, the plane may have a certain thickness defined by the axial resolution of the tool. For example, if all eight transducers 4 of a single module 6 are triggered at a different time, i.e., every 3 ms, then the plane has a thickness of approximately 2.4 mm (at a logging speed V of 0.1 m/s). That is, the plane and thus each measurement may have an error associated therewith. Compensation techniques may be employed, if applicable.

The data acquired through such a scan/logging operation may be stored in a matrix. One example matrix may store the data such that each row corresponds to an azimuthal scan on the same module 6 and each column corresponds to a measurement with a particular transducer 4 of that module 6. Other matrices may be used depending upon the preferred means of logging and combining the obtained measurements.

Figure 4:
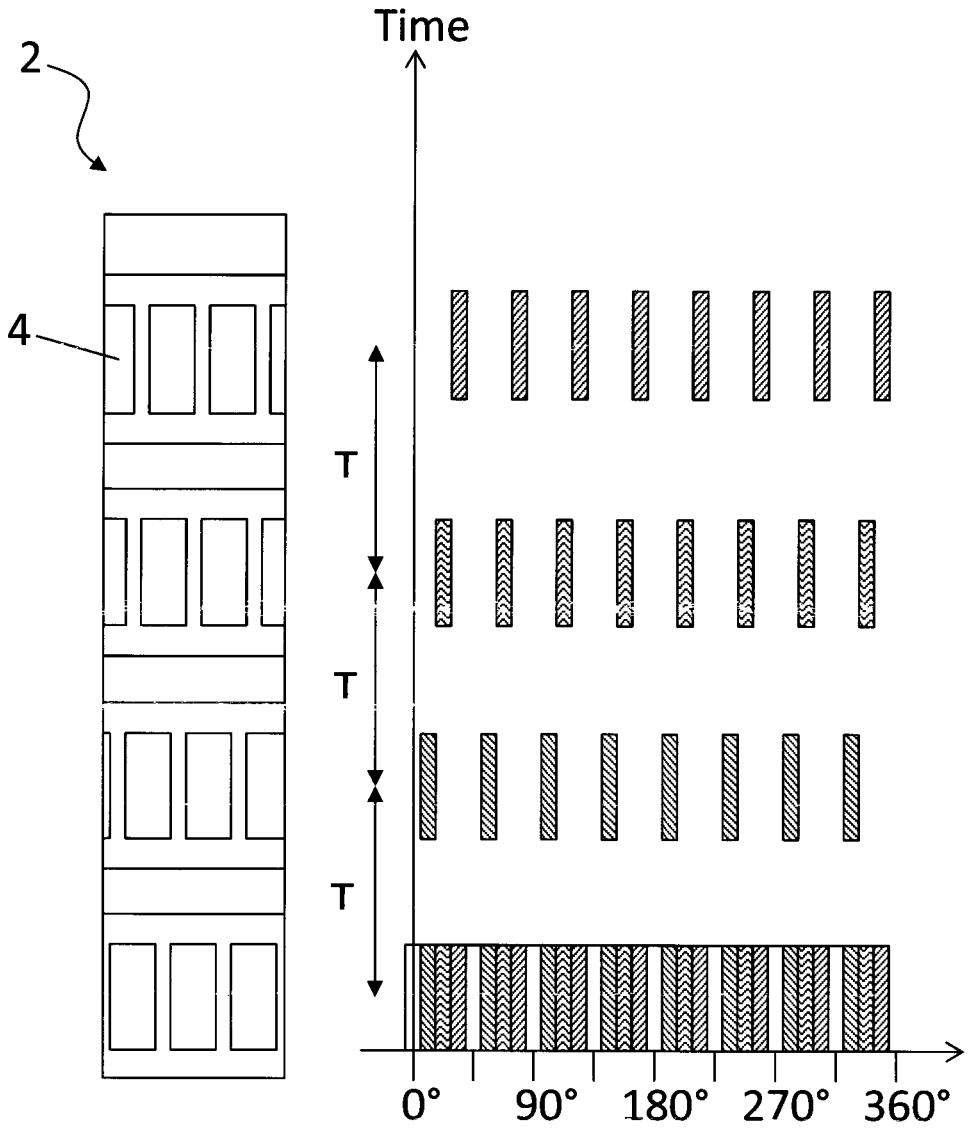
FIG. 4 shows a combination pattern from a plurality of modules.

In order to reconstruct a full azimuthal scan at a given depth, measurements that correspond to the same axial depth or plane need to be combined together. When using the matrix described above, this implies combining the relevant rows of the matrix. FIG. 4 shows the relevant measurements made for each module 6 for any given plane; this also corresponds to the relevant rows. The lower-part of the graph of FIG. 4 shows the combined measurements for the four modules 6—note that the hollow, unfilled rectangles indicate the measurements for the lowest module.

The measurements to be combined are; those of the first module (i.e., the module 6 at the lowest position in FIG. 4) at time zero, those for the second module after a delay of $\tau$, those for the third module after $2\tau$, and those for the fourth module after $3\tau$. These four sets of measurements or rows may be combined together to produce a full azimuthal scan for the $N^{th}$ depth point. Then for the next depth along the longitudinal axis of the wellbore, this process is repeated, but now involving the measurements of the first module 6 at $T_1$, that of second module 6 at $\tau+T_1$, and so on.

Figure 5A:
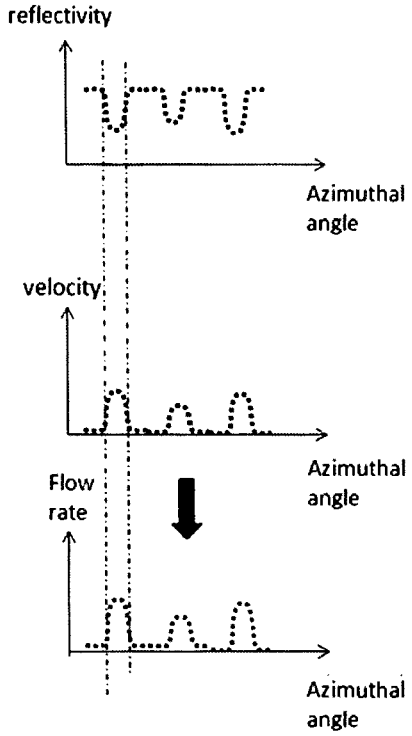
FIG. 5*a* shows measured and derived parameters along a single plane.

Embodiments of the present disclosure preferably make use of range-gated ultrasonic Doppler, which is extensively described in the related literature and a discussion thereof is not repeated herein for conciseness. It is sufficient to state that range-gated ultrasonic Doppler is capable of producing an echo strength profile (or a reflectance/transmittance profile) and a radial flow velocity. In FIG. 5*a*, an example of the reflectivity and flow velocity corresponding to three perforations P detected by a single module 6 is shown. Generally speaking, the reflectivity can be used for gauging a size of the perforation P, while the Doppler shifted frequency can be used to gauge the flow into (or out of) the perforation P. Signals from locations close to the well casing 104 (from a short distance in front of the mouth of the perforation P up to, for example, 1 cm inside the perforation P) may be selected, via suitable range-gating, to measure the reflectivity of the well casing 104 and the velocity of the flow out of the perforation P. From these measurements, it is also possible to derive a flow rate of fluid entering or exiting the individual perforations P.

Figure 5B:
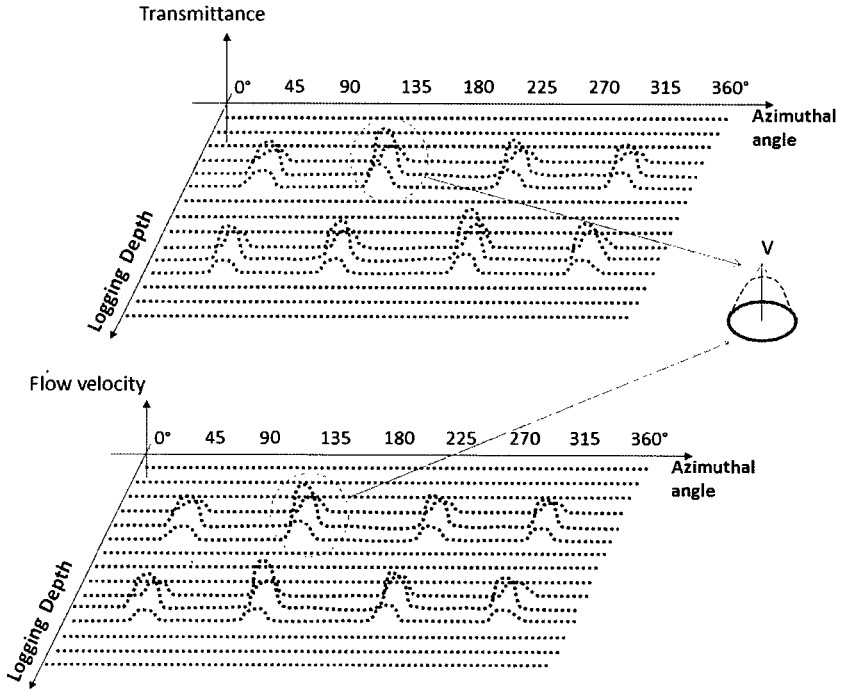
FIG. 5*b* shows measured and derived parameters from multiple planes.

When the measurements of all the transducers 4 at various positions along the longitudinal axis of the wellbore, i.e., the positions defining the intersecting planes, are combined, images of the well casing 104 can be produced. An example of such an image is shown in FIG. 5*b*. In FIG. 5*b*, it is clearly identifiable that eight perforations P have been detected. Equally, it can be seen that fifteen complete azimuthal scans have been performed at various depths of the wellbore.

Generally, when there is a peak in the transmittance (or a trough in the reflectance) it denotes a variation in the distance to the well casing 104; in other words, a hole or perforation P. Equally, when there is a peak in the radial flow velocity as a result of the Doppler shift, this indicates a moving speed of the fluid flowing out of the perforation P. In the case of an injecting well, the velocity profile may be negative, i.e., display a trough. Combining these profiles can lead to a determination of the flow rate; an example is illustrated by the two circled areas in FIG. 5*b*.

In further embodiments, when the obtained data is combined with a suitable holdup measurement, which determines the constitution of fluid from/into the perforation P, multiphase zonal contributions can be calculated. That is, individual phase flow rates, and consequently individual zonal inflow phase rates, may be calculated.

A separate azimuthal sensor may also be provided in some embodiments and mounted on the tool string, wherein this separate azimuthal sensor provides a measurement of a reference azimuthal angle of the logging tool in the borehole. Accordingly, data acquired through the measurement apparatus 2 can be referenced to this angle, thereby allowing for the accurate combination of data.

In some cases, the transducers 4 may also be rotated with respect to a longitudinal axis of the transducers 4 themselves. That is, the normal of the transducers 4 may be offset with respect to the radial direction. As a basic example, a square-shaped cross-sectional surface of the measurement apparatus 2 may have three transducers 4 provided on the side of the square-shape. A middle one of the transducers 4 may be provided with its normal coincident with the radial direction. However, the normal of the two outer transducers 4, in this case, are not coincident but offset. In such a case, the measurement apparatus 2 may be provided with an indication of the facing direction of each transducer 4, such that, effectively, the measurement apparatus 2 knows which direction the transducers 4 face and subsequently which angles of the well casing the transducers 4 image in order to identify which part of the azimuthal scan is performed by the transducer 4. The transducers 4 do not have to be provided in parallel with an outer surface of the measurement apparatus 2, but may be rotated with respect to the outer surface.

Figure 6:
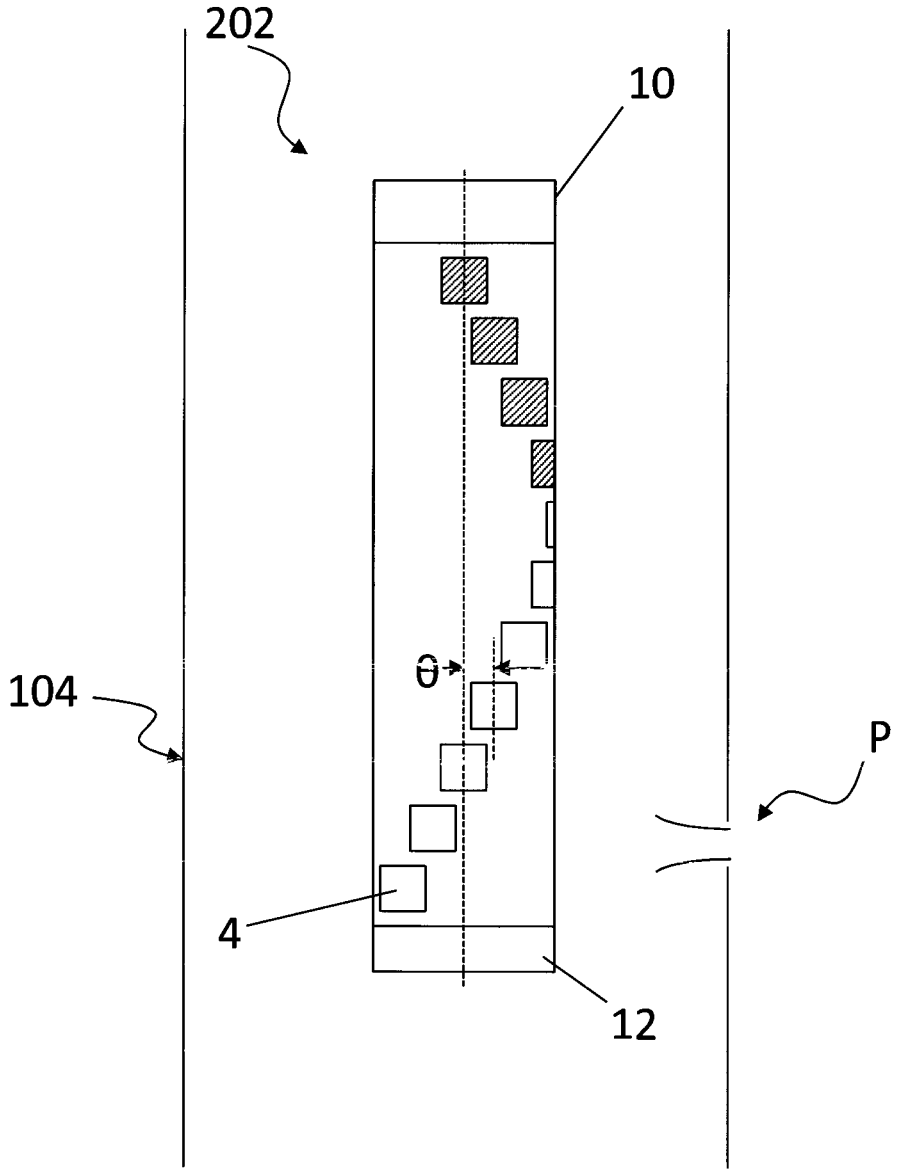
FIG. 6 shows a measurement apparatus according to an embodiment of the present disclosure.

FIG. 6 shows a second embodiment according to embodiments of the present disclosure. The second embodiment works on the same principle as the first embodiment and obtains azimuthal scans at various planes intersecting the well casing 104. The second embodiment therefore displays the same or similar advantages as the first embodiment. The same or similar components are provided with the same reference signs and the discussion thereof will be omitted.

In FIG. 6, one can see that a measurement apparatus 202 is provided in relation to the well casing 104 lining the wellbore. The measurement apparatus 202 may be disposed in relation to a downhole tool, in a similar fashion to the first embodiment. The measurement apparatus 202 comprises a plurality of transducers 4 which are preferably identical in construction to the transducers 4 of the first embodiment. An electronics module 10 and a header portion 12 may also be provided, wherein these components display the same functions as their counterparts in the first embodiment.

In contrast to the first embodiment, the second embodiment provides the transducers 4 in a helical pattern along a length of a measurement body 206. As seen in FIG. 6, the transducers 4 extend the length of the measurement body 206 from an initial position. Each transducer 4 may, preferably, be disposed at a different axial position; that is, at a different position along the length of the measurement body 206.

As in the first embodiment, each transducer 4 is provided at a different angular or azimuthal position with respect to a central longitudinal axis of the measurement body 206. In one configuration, each transducer 4 may be offset by an angle θ from the adjacent transducer, as seen in FIG. 6. To this end, the shaded transducers 4 of FIG. 6 represent transducers 4 positioned on the back side of the measurement body 206. The angle θ may be equal between each transducer 4, or it may vary depending upon the desired pattern to be used.

The helix pattern of transducers 4 may circle once around the measurement body 206, wherein the helix pattern traverses through 360°, as is approximately shown in FIG. 6. Alternatively, the helix pattern may circle around the measurement body 206 any multiple of times, for example, twice, wherein the helix patter traverses through 720°. Moreover, two or more helix patterns may be provided simultaneously; for example, a double helix pattern.

However, as with the first embodiment, each transducer 4 is preferably provided at a unique longitudinal and azimuthal position with respect to the measurement body 206. In this way, a single measurement from each of the transducers 4 provides a complete 360° at a single plane. In other words, a transmittance and radial flow velocity according to FIG. 5*b* can be obtained when combining a plurality of measurements.

In a similar manner, the axial resolution of the measurement apparatus 202 of the second embodiment is dependent upon the logging speed V and the time required to scan the transducers 4 in the measurement body 206, $T_1$. The azimuthal resolution is dependent upon the size of the transducers 4 and the angle θ between. Extension portions 26 may also be employed to extend the height of the transducers 4, thereby altering the focal zone.

The transducers 4 may be activated in a specific sequence befitting the arrangement of transducers 4, the desired logging speed V and axial resolution. In particular, certain transducers 4 may be pulsed simultaneously, preferably using different frequencies and/or channels, if desired. This may increase the axial resolution and speed of the logging procedure.

In one configuration, the measurement body 206 is a single body housing all of the transducers 4. In another configuration, the measurement body 206 may be split into modules, whereby each module contains a part of the plurality of transducers 4. Each module may also be identical and coupled via a coupler 8, as in the first embodiment.

Each module may therefore comprise a number of transducers 4 forming part of the helix pattern such that, when the correct number of modules are assembled, the modules and transducers 4 form the helical pattern.

Figure 7:
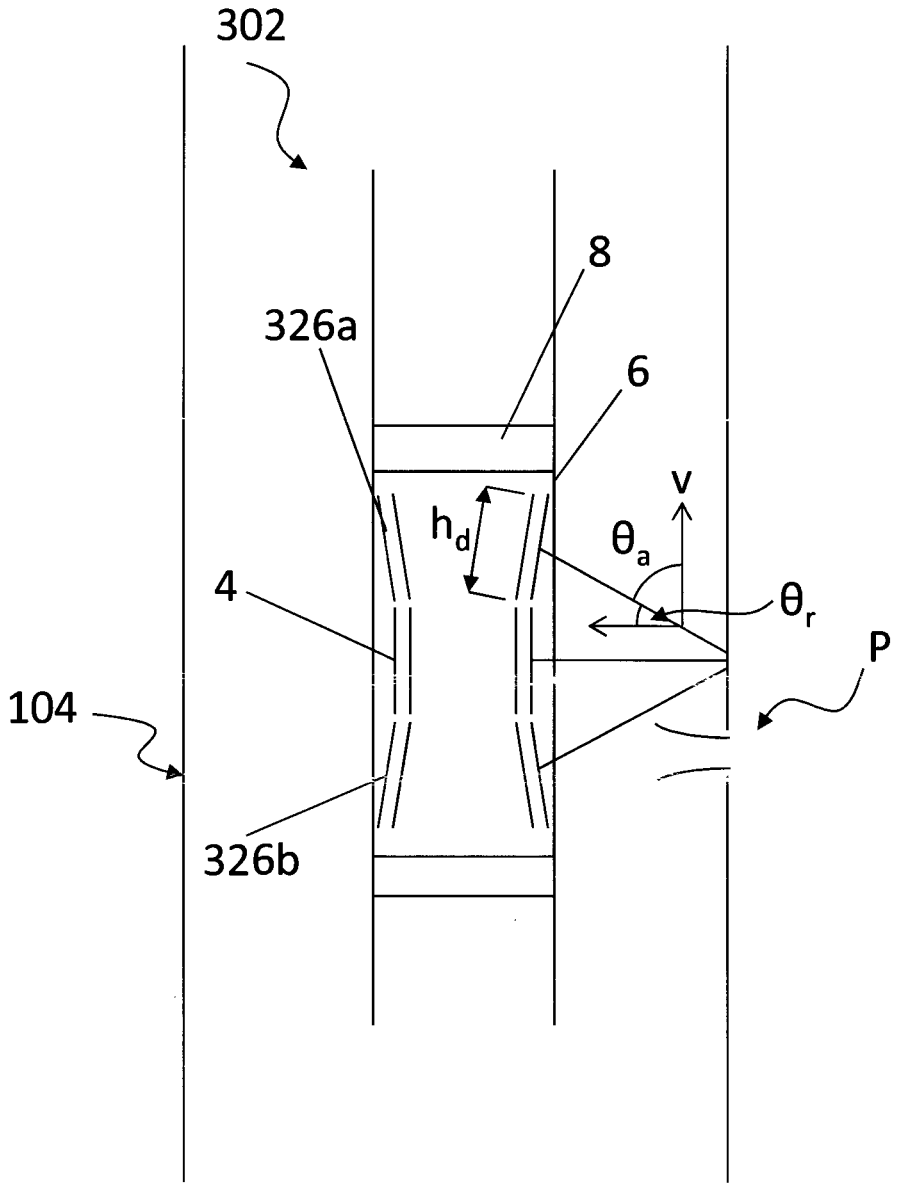
FIG. 7 shows a measurement apparatus according to an embodiment of the present disclosure.

A third embodiment is depicted in FIG. 7. As can be seen, the third embodiment is similar to the first embodiment, although the principle is also applicable to the second embodiment. In the third embodiment, each transducer 4 of each module 6 of the measurement apparatus 302 is provided with tilted extension portions 326*a*, 326*b*. The tilted extension portions 326*a*, 326*b* may be similar in composition to the transducers 4 and operate in a similar manner. Preferably, an upper extension portion 326*a* is tilted downwards—that is, the field of view F is displaced downwards with respect to the well casing 104. Conversely, a lower extension portion 326*b* is tilted upwards—that is, the field of view F is displaced upwards with respect to the well casing 104.

Figure 8:
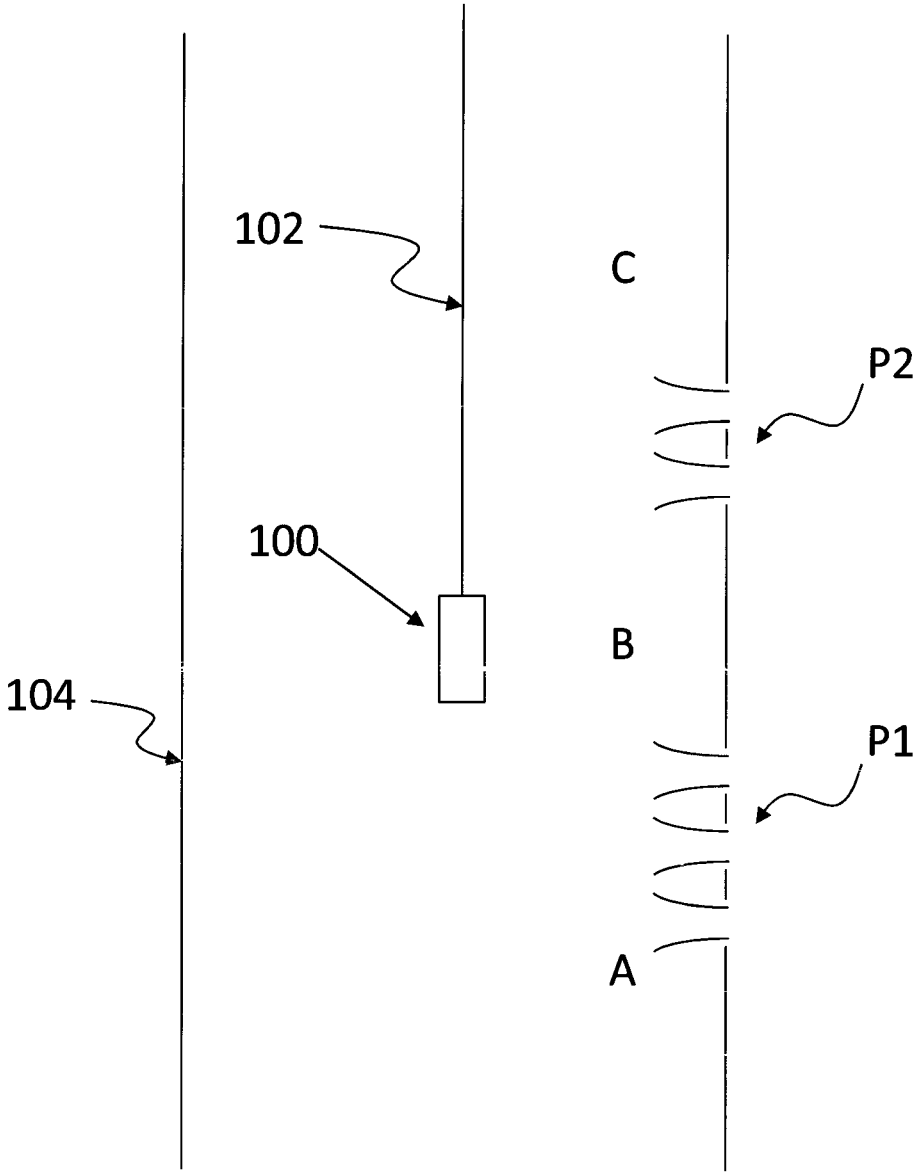
FIG. 8 shows a prior art method of obtaining a flow rate measurement.

In this embodiment, an ultrasonic beam that is deviated by an angle of $\theta_r$ from the radial direction of the wellbore is generated. Such a deviation creates a Doppler angle of $\theta_a$ with respect to the axial direction. As shown in equation (4), for a given flow velocity, v, the Doppler frequency shift is a function of cos $\theta_a$, i.e., $$\Delta f = 2\cos\theta_a \frac{f_e}{c} v, \tag{4}$$

where: c is the speed of sound, and $f_e$ the operating frequency. The more $\theta_a$ deviates from 90°, the greater the frequency shift is. When the transducer 4 is located at an axial depth of sufficient distance from the perforations and the flow direction is primarily axial, range-gated Doppler signals from at least one, but preferably more than one tilted extension portion 326*a*, 326*b*, are processed to produce at least one, but preferably more than one, axial flow velocity profile that expand from the tool surface to the casing at the corresponding azimuthal angles. The flow rate of the borehole can be derived by integrating such profiles along the radial directions. This provides flow measurement capability at the depths in between the perforated zones, just like flow sensors in a production logging application, i.e., an overall flow rate from a perforated zone can be derived from the difference between the flow rate measured above the zone and that measured below it, as described in relation to FIG. 8.

The tilted extension portions 326*a*, 326*b* preferably have a sufficiently small size in order to reduce the near field distance. For instance, a 2 MHz extension portion 326*a*, 326*b* with $h_d$=5 mm (see FIG. 7) has an near field distance of about 8 mm, which means that the measured velocity profile is not very reliable from the tool to about 8 mm away, albeit more reliable from 8 mm to the casing.

The tilted extension portions 326*a*, 326*b* and un-tilted transducers 4 may be grouped together to produce a better and variable beam focusing for perforation inspection. This can be achieved by phasing the driving voltages and received signals of different transducers 4 or extension portions 326*a*, 326*b*, similar to the methods used in medical imaging. The phasing control will also allow beam steering to be implemented, so that the focal point on the well casing 104 can be moved up or down by a small distance from its normal inspection point. This increases the resolution of the inspection in the axial direction of the borehole.

Embodiments of the present disclosure provide the ability to log perforations P on a perforation-by-perforation basis, using range-gated pulse-wave Doppler measurement techniques. Such logging is simply not attainable using the differential measurements of the prior art; see FIG. 8. Specific properties of the perforations P (such as size, flow velocity, and flow rate) can be measured or derived from these measurements.

No moving parts are provided in embodiments of the present disclosure, meaning that the measurement apparatus 2 of embodiments of the present disclosure is much more robust compared to systems employing rotating transducer arrays. Moreover, the measurement apparatus 2 of embodiments of the present disclosure is non-invasive inasmuch as the transducers 4 are positioned a sufficient distance away from the mouth of the perforation P when taking measurements, unlike cases where the sensors are intimately engaged with the well casing 104, thereby avoiding perturbing the flow of the perforation P. This improves the accuracy of the obtained measurements, as well as improving the robustness and fidelity of the measurement apparatus 2.

The measurement apparatus 2 may be used as a diagnostic or quality check service and/or as a way of building a comprehensive data base that can be used to study the effects of different designs of shaped charges/perforation guns on different formations. Such a logging can only be performed after the perforations P have been produced, but a comprehensive database can aid in the perforation production strategies in the future.

Other applications may also include logging of injection wells (especially in difficult cases such as polymer injection for enhanced oil recovery), or in logging production from deviated wells where the complex velocity and holdup gradients makes it very difficult to resolve inflows with conventional sensing arrays. Particularly for injection wells, a non-invasive logging technique is desired so as not to interfere with the inflow of fluid. The measurement apparatus 2 may also be used to determine which zones of a wellbore are taking treatment fluids during matrix treatment processes, such as acidizing. Additionally, the measurement apparatus 2 may be employed in conjunction with a perforation gun in order to determine the flow into the gun.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

While the principles of the disclosure have been described above in connection with specific apparatuses and methods, it is to be clearly understood that this description is made only by way of example and not as limitation on the scope of the invention.

What is claimed is:

1. A measurement apparatus for being carried by a downhole logging tool, the measurement apparatus adapted to non-invasively log fluid flow at perforations in a well casing lining a wellbore, the measurement apparatus comprising:

a plurality of transducers arranged adjacent an outer surface of the measurement apparatus and at azimuthal angular positions with respect to a longitudinal axis of the measurement apparatus;

a plurality of modules extending along the longitudinal axis, wherein:

the transducers are adapted to transmit and detect an acoustic pulse, each transducer is arranged at a different azimuthal angle with respect to each of the remaining transducers and the transducers are adapted to be triggered in a sequence that takes into consideration a moving speed of the measurement apparatus when carried by the downhole logging tool such that, in one cycle, each transducer detects a different azimuthal angle on at least the same plane intersecting the wellbore perpendicularly to a longitudinal axis of the wellbore at least one of the plurality of transducers is located at a different longitudinal position along the longitudinal axis, such that the transducers are provided in a staggered arrangement, and at least one of the transducers includes only one or only two extension portions situated above and/or below the at least one of the transducers, the extension portions being additional transducers, wherein the extension portions are tilted relative to the longitudinal axis of the measurement apparatus, and each module contains one more of the plurality of transducers arranged at different positions along the longitudinal axis and at different azimuthal positions, such that each transducer of each module is offset in the azimuthal direction with respect to the transducers of all the other modules.

2. The measurement apparatus of claim 1, wherein the plurality of modules are stacked upon each other extending along the longitudinal axis of the measurement apparatus.

3. The measurement apparatus of claim 1, further comprising:

a plurality of couplers, the couplers adapted to couple a first module of the plurality of modules to a second module of the plurality of modules such that each transducer of each module is offset in the azimuthal direction with respect to the transducers of all the other modules.

4. The measurement apparatus of claim 1, wherein each of the transducers is arranged at a different position along the longitudinal axis of the measuring apparatus thereby forming a helical pattern.

5. The measurement apparatus of claim 1, wherein the measurement apparatus further comprises an electronics module adapted to sequentially trigger the transducers.

6. The measurement apparatus of claim 1, wherein the transducers are adapted to detect a Doppler frequency shift in the acoustic signal reflected back from the proximity of the well casing to the transducers.

7. A downhole logging tool comprising the measurement apparatus of claim 1.

8. A method of non-invasively logging fluid flow at perforations in a well casing lining a wellbore, the method comprising:

providing the measurement apparatus of claim 1; and transmitting and detecting acoustic signals using the plurality of transducers wherein, in the presence of a perforation, the acoustic signals interact with the flow from or into the perforation.

9. The method of claim 8, further comprising:

providing the plurality of transducers at different positions along the longitudinal axis of the measurement apparatus;

lowering the measurement apparatus down the wellbore; and transmitting the acoustic signal from each transducer when each transducer is level with at least one reference point defined relative to an axial length of the wellbore.

10. The method of claim 8, wherein an axial resolution obtained by the measurement apparatus is dependent upon the movement speed of the measurement apparatus in a vertical direction down the wellbore.

11. The method of claim 8, further comprising:

detecting a reflectance and/or transmittance associated with the acoustic signals of each transducer along a radial depth of the well casing;

detecting a radial flow velocity profile associated with the acoustic signals of each transducer along the radial depth the well casing; and deriving a flow rate using the detected reflectance and/or transmittance and the detected radial flow velocity profile, wherein, in the presence of a perforation, the reflectance and/or transmittance and the radial flow velocity are different compared to when a perforation is not present.

* * * * *